US011440623B2

(12) United States Patent
Yebra et al.

(10) Patent No.: US 11,440,623 B2
(45) Date of Patent: Sep. 13, 2022

(54) METHOD FOR IMPROVING A FLUID DYNAMIC PROFILE OF A MARINE VESSEL, A MARINE VESSEL HAVING AN IMPROVED FLUID DYNAMIC PROFILE, AND A COATING SYSTEM FOR IMPROVING THE FLUID DYNAMIC PROFILE

(71) Applicant: HEMPEL A/S, Kgs. Lyngby (DK)

(72) Inventors: Diego Meseguer Yebra, Kgs. Lyngby (DK); Stefan Møller Olsen, Kgs. Lyngby (DK); Eduardo Andres Martinez, Burgos (ES); Kim Flugt Sørensen, Kgs. Lyngby (DK)

(73) Assignee: HEMPEL A/S, Lyngby (DK)

( * ) Notice: Subject to any disclaimer, the term of this patent is extended or adjusted under 35 U.S.C. 154(b) by 282 days.

(21) Appl. No.: 16/757,610

(22) PCT Filed: Nov. 6, 2018

(86) PCT No.: PCT/EP2018/080280
§ 371 (c)(1),
(2) Date: Apr. 20, 2020

(87) PCT Pub. No.: WO2019/086698
PCT Pub. Date: May 9, 2019

(65) Prior Publication Data

US 2021/0197928 A1 Jul. 1, 2021

(30) Foreign Application Priority Data

Nov. 6, 2017 (EP) ..... 17200113

(51) Int. Cl.
*B63B 3/24* (2006.01)
*B63B 73/20* (2020.01)
(Continued)

(52) U.S. Cl.
CPC ..... *B63B 3/24* (2013.01); *B63B 59/04* (2013.01); *B63B 73/20* (2020.01); *B63B 73/43* (2020.01)

(58) Field of Classification Search
CPC ..... B63B 3/24; B63B 59/04; B63B 73/20; B63B 73/43
(Continued)

(56) References Cited

U.S. PATENT DOCUMENTS 1,877,235 A * 9/1932 Goodyear ..... B63B 3/24 114/79 R
3,607,821 A 9/1971 Clarke et al.
(Continued)

FOREIGN PATENT DOCUMENTS

EP 0 204 456 B1 10/1991
EP 0 297 505 B1 9/1992
(Continued)

OTHER PUBLICATIONS

International Search Report (PCT/ISA/210) issued in PCT/EP2018/080280, dated Feb. 1, 2019.
(Continued)

*Primary Examiner* — Daniel V Venne
(74) *Attorney, Agent, or Firm* — Birch, Stewart, Kolasch & Birch, LLP

(57) ABSTRACT

A method for improving a fluid dynamic profile and fouling properties of a marine vessel with a welding seam which forms a cap protruding above a surface being under the waterline of a vessel. The method comprising amending the welding seam by applying a fairing to the underwater surface, e.g. by use of filler. A vessel with a fairing, and a coating system for a vessel and including a fairing.

23 Claims, 8 Drawing Sheets

(51) Int. Cl.
*B63B 73/43* (2020.01)
*B63B 59/04* (2006.01)

(58) Field of Classification Search
USPC ..... 114/65 R, 67 R
See application file for complete search history.

(56) References Cited

U.S. PATENT DOCUMENTS

| | | | | |
|---|---|---|---|---|
| 4,147,688 | A | 4/1979 | Makhlouf et al. | |
| 4,214,332 | A * | 7/1980 | Stoner | B63B 3/09 114/65 R |
| 4,493,914 | A | 1/1985 | Chattha | |
| 4,960,828 | A | 10/1990 | Higuchi et al. | |
| 5,193,939 | A | 3/1993 | Nagatani et al. | |
| 6,464,786 | B1 | 10/2002 | Hopson | |
| 2015/0141562 | A1 | 5/2015 | Fukuta et al. | |

FOREIGN PATENT DOCUMENTS

| | | | |
|---|---|---|---|
| EP | 0 342 276 | B1 | 9/1993 |
| EP | 0 471 204 | B1 | 3/1997 |
| EP | 0 779 304 | A1 | 6/1997 |
| FR | 2 213 867 | A1 | 8/1974 |
| FR | 2 432 428 | A1 | 2/1980 |
| GB | 364 120 | A | 1/1932 |
| JP | 48-29551 | B1 | 9/1973 |
| JP | 57-177068 | A | 10/1982 |
| JP | 2-197579 | A | 8/1990 |
| KR | 10-2014-0117986 | A | 10/2014 |
| WO | WO 83/03787 | A1 | 11/1983 |
| WO | WO 2004/018533 | A1 | 3/2004 |
| WO | WO 2011/076856 | A1 | 6/2011 |
| WO | WO 2014/010702 | A1 | 1/2014 |
| WO | WO 2015/114091 | A1 | 8/2015 |
| WO | WO 2016/066567 | A1 | 5/2016 |

OTHER PUBLICATIONS

Written Opinion ofthe International Searching Authority (PCT/ISA/237) issued in PCT/EP2018/080280, dated Feb. 1, 2019.

* cited by examiner

METHOD FOR IMPROVING A FLUID DYNAMIC PROFILE OF A MARINE VESSEL, A MARINE VESSEL HAVING AN IMPROVED FLUID DYNAMIC PROFILE, AND A COATING SYSTEM FOR IMPROVING THE FLUID DYNAMIC PROFILE

INTRODUCTION

The invention relates generally to fluid dynamic properties of a marine vessel and particularly a vessel having welding seams extending on an outer surface below the waterline of the vessel. The invention further relates to a coating system, particularly to an antifouling coating system for improving fluid dynamic properties of an underwater surface of a vessel.

BACKGROUND

Underwater structures exposed to seawater are subjected to fouling by marine organisms such as green and brown algae, barnacles, mussels, tube worms and the like. Fouling is undesired on marine constructions such as vessels, oil platforms, buoys, etc. because it may lead to biological degradation of the surface, increased load, and accelerated corrosion. On vessels, the fouling will lead to increased drag resistance which will cause reduced speed and/or increased fuel consumption. It can also result in reduced maneuverability.

In the early days of steel vessel construction, the plates were arranged to form lap joints, and assembled by rivets. Welded hulls of marine vessels have existed for almost a century. Welding is a fabrication process by which metal plates are joined by fusion.

Typically, the plates are arranged in butt joints thereby avoiding the pronounced step in an overlap. In this position, base material at the edges of the plate is melted and additional material is typically added. The resulting seam of a correctly executed welding process defines a cap with a cap height which is dictated by quality and strength requirements related to the vessel hull and plate thickness etc. The cap is low relative to a typical step of a lap joint, and the shape of the cap of a correctly made welding seam is normally smooth and round.

For applications where a particularly nice appearance is desired, e.g. above waterline of expensive superyachts and pleasure crafts, the cap of welding seams over the waterline is sometimes grinded until it is in level with the surface of the steel plates or the entire hull is plastered over the water line to cover surface irregularities. This process is purely for aesthetic reasons, and may be undesirable from a structural perspective.

The welding process, while providing a strong and simple way of joining plates, has certain disadvantages as compared to a non-heating assembly process such as riveting etc. Due to the intensive heat input, a heat affected zone (HAZ) is created on both sides of the seam. In this zone, the structure of the metal may have changed. Accordingly, it is an important aspect in vessel manufacturing to ensure suitable protection particularly at the welding seam and HAZ.

To ensure the layer thickness of the coating, the welding seams are often stripe coated by brush before the entire welded vessel structure is spray painted. This process is time consuming and expensive.

In addition to the aspects of the HAZ, fouling is sometimes experienced in connection with welding seams under the waterline. Without being bound by theory, it is believed that such fouling can be caused by anchor points formed by corners of the welding or flow conditions in the vicinity of the welding, and typically, the fouling can be experienced even when antifouling is applied with caution.

SUMMARY

To reduce drag and thereby to reduce fuel consumption, or potentially increase the speed of a vessel and/or to protect a welding seam and associated HAZ of a welded vessel hull, and/or to reduce the cost in coating of welded vessels and/or to improve the coating quality, and/or to reduce fouling, the invention provides a method according to claim 1 and a vessel according to claim 10 and a coating system according to claim 13.

As mentioned previously, the welding seams form caps which are smoothly rounded and therefore already have a shape which is superior to a lap joint relative to fluid dynamic properties. According to a first aspect, a method is provided for amending a profile of the vessel at the welding seam by applying a fairing. This may reduce the drag further. Additionally, the amending of the profile changes the flow condition around the welding seam and can thereby reduce fouling.

Herein, the term fairing is considered to cover an element located against the welding seam and against the underwater surface thereby amending the profile of the vessel at that welding seam. Additionally, the fairing may protect the welding seam and the HAZ, particularly against ingress of water which could lead to corrosion at the welding seam. Additionally, the change of the profile may change the antifouling properties at the welding seam.

In a first group of embodiments, the fairing may be constituted by a pre-defined element which is attached to the welding seam, e.g. a rigid element or a soft bendable element, e.g. in the form of adhesive tape, an extruded profile, e.g. of a polymer material, or a rigid element, e.g. of composite material, metal, wood, or plastic. In this group of embodiments, the method comprises the step of attaching the fairing, e.g. adhesively to the underwater surface and/or to the welding seam, and optionally to prepare the surface by cleaning and/or primer coating the surface prior to the attaching of the fairing, and optionally by providing layers of coating on the fairing, e.g. a fouling control surface coating system.

The pre-defined element may be supplied e.g. on a roll, which is unrolled along the welding seam. It could be attached to the underwater surface by use of an adhesive. It could be applied to cover the welding seam completely, or it could be attached, such that only a part of the welding seam is covered. It could extend along only one side of the welding seam, or it could extend along both sides of the welding seams.

The fairing could be solid, or it could be hollow or porous to reduce weight and material consumption.

Particularly, the fairing may be applied to the completely finished welding seam, i.e. after the welding process is completed, and preferably, the fairing is applied after the welded material has cooled down to a normal temperature.

Particularly, the fairing may be maintained on the surface throughout the lifetime of the vessel and particularly it remains on the underwater surface of the vessel while the vessel is operated such that it can reduce the fuel consumption by improving the hydrodynamic properties of the vessel.

In a second group of embodiments, the fairing is constituted by filler and the method comprises the step of applying the filler in an unsolidified condition to the underwater surface, shaping the filler on the welding seam, and solidifying the filler to define a fairing.

Also relative to the second group of embodiments, the fairing is applied to the completely finished welding seam, e.g. after the welded material has cooled down to a normal temperature, and maintained during operated of the vessel to improve the hydrodynamic properties of the vessel.

In the following, the invention will be described by reference to the first and the second group of embodiments, some features are, however, relevant only for one of the first and second groups of embodiments, and in that case, the disclosure applies for the relevant group. Generally, whenever reference is made to fairing, the feature is relevant for both groups of embodiments, and when reference is made to filler, the feature is relevant to the second group of embodiments.

Herein, the term "filler" means a putty material which is unsolidified and therefore can be shaped to form a fairing at the welding seam and which can subsequently be solidified.

Herein, the term welding seam is particularly a seam by which two plates of the hull are joined by welding. Particularly, the method may imply identifying a butt-joint welding seam which assembles two outer skin plates of the hull for amending specifically those welding seams by applying the fairing. The butt-joint may e.g. be a single welded butt joint, a double welded butt joint, and open or closed butt joint, and the geometry could e.g. be square butt joint, V-joints, J-joints, or U-joints.

When seen in a cross-section perpendicular to the welding seam, the fairing may be triangular in shape, with a lower surface of the triangle following the underwater surface, and with two top surfaces of the triangle extending from a top point above the welding seam and sloping from that top point downwards towards the lower surface. The triangular shape may particularly have the shape of an isosceles triangle, and the height at the welding seam may particularly be higher than the height of the welding seam.

The lower surface of the triangle may particularly be at least 10 times the height of the welding seam.

The top surfaces may particularly curve inwardly and form a convex shape, or they may curve outwardly and form a concave shape.

The fairing may particularly be applied to cover both the welding seam and the HAZ of the welding seam. In that way, the fairing may not only improve the fluid dynamic properties, but also reduce the degradation by covering the affected parts of the assembled plates. The fairing may e.g. be made from a sealing, protective material, e.g. containing epoxy to thereby provide water protective encapsulation of the underwater surface and/or welding seam. The fairing may also provide air-tight encapsulation of the underwater surface and/or welding seam.

In one embodiment, the fairing is arranged symmetrical about the welding seam.

In one embodiment, the welding seam is completely encapsulated in the fairing, and in one embodiment, the fairing has a width transverse to the longitudinal direction in the range of at least 10 cm or even 20 cm corresponding to at least 10 or 20 times the height of a 1 cm high welding seam.

The fairing could be arranged directly on the uncoated welding seam, and may it-self have primer properties. The fairing may also be attached to a primed surface, i.e. the welding seam and/or the underwater surface could be coated with a primer before the fairing is applied.

In the second group of embodiments, the filler could be applied directly to the uncoated surface of the welding seam or on the surface of a primer, and the filler may be selected such that it has protective characteristics itself and thereby protect the welding seam and the surrounding area. If the filler is applied on primer, the primer may effectively bind to the steel surface and to the filler. The primer may be more low viscous than the filler to therefore allow the primer to fill out irregularities in the steel surface and smoothen the surface prior to the application of a thicker and more viscous filler.

The fairing could be covered with a coating, e.g. an antifouling surface coating system, e.g. a multilayer antifouling coating system.

The fairing may be made from a material providing antifouling properties and thereby constitute a part of a fouling control surface coating system.

The fairing may, irrespective of any antifouling property, reduce fouling by amending the flow conditions at the welding seam.

Welding seams on the underwater surface may have different impact on the drag resistance depending on the location and direction of the welding seam relative to the sailing direction. In the following, the term "longitudinal direction" refers to a sailing direction for which the vessel is designed and the longitudinal welding seams are welding seams extending in the longitudinal direction. Likewise, the term "transverse direction" refers to a direction being transverse, e.g. perpendicular to, the sailing direction for which the vessel is designed and the transverse welding seams are welding seams extending in a transverse direction. The method may comprise the step of identifying at least one welding seam extending on the underwater surface in the longitudinal direction. Since this welding seam is in the sailing direction and therefore has less influence on the fluid dynamic properties during sailing, the method may include applying fairing only to the transverse welding seams and not to the longitudinal welding seams. Accordingly, an antifouling surface coating system may be applied to the longitudinal welding seam, e.g. on top of a primer or tie-coat without applying the fairing, and the antifouling may be applied to the transverse welding seam on top of a fairing.

One step could be to identify those welding seams extending transverse to the sailing direction and applying the fairing only to those welding seams. Selecting only to apply the fairing to transverse welding seams allows an optimisation of the working procedure, and a lighter and potentially faster hull.

The fairing may be applied only on a downstream side of the welding seam facing backwards relative to the sailing direction. This is where the biggest turbulence is created, and by applying the fairing only on this side of the welding seam, the amount of fairing may be reduced.

The fairing may be applied selectively at a front end of the vessel, e.g. at most on welding seams in a forward half part of the underwater surface of the vessel, the forward half part of the underwater surface extending from a front end pointing forward in the sailing direction and half the way towards a rear end of the vessel. In one example, it is only applied to the forward ⅓ of the vessel, or only to the forward ¼ of the vessel. The fouling control system could be applied directly to the welding seams which extend in the sailing direction, or primer coating could be applied between the welding seam and the fouling control surface coating system.

The application of a fairing only to selected welding seams has a further advantage of allowing unhindered inspection of those welding seams not being covered.

In this process, the fairing may subsequently be covered with the same fouling control surface coating system as that used for covering the welding seams extending in the sailing direction.

In one embodiment, the fairing will be applied on top of a primer, e.g. an anticorrosive primer. The anticorrosive primer will be applied on the entire hull directly to the underwater surface. The surface of the hull could be a steel surface, e.g. treated by abrasive blasting or the existing surface could be an aged paint surface of an old hull. Following the application of the anticorrosive primer, the fairing will be applied at the welding seam area as described above. On top of the fairing, a top coat may be applied. The top coat could comprise one or more layers of a fouling control surface coating system. Additionally, one or more layers of a tie-coat could be applied below the top coat.

In one embodiment, the anticorrosive primer system is an epoxy-type anticorrosive primer, and the fairing is made from an epoxy-containing material, e.g. from an epoxy based filler. The tie-coat will be an epoxy, silicone, or polyurethane based tie-coat, and the fouling control surface coating system comprises one or more antifouling coats as described below, or a silicone system, where the silicone system can comprise similar or different layers of silicone coatings. An example of a suitable top coat for fouling control can be found inter alia in the patent publication WO2011076856

In another embodiment, the fairing will be applied directly to the existing surface of the ship hull. The existing surface could be either an aged coating system or bare steel from e.g. abrasive blasting pre-treatment. On top of the fairing, a layer of anticorrosive primer will be applied, followed by a top coat, e.g. comprising one or more layers of tie-coat and a fouling control surface coating system as described above.

In one embodiment, the fairing has elastic properties allowing it to deform elastically to thereby improve the ability to adapt to the shape of the hull and to deflect when the hull deflects, e.g. in high waves.

The method of the first aspect may particularly apply to welding seams where two bottom skin panels are joined in a butt joint.

The method may form part of a method for making a hull of a marine vessel, the method comprising the step of arranging edges of at least two bottom skin panels in a butt joint to form adjacent edges, joining the adjacent edges by at least one welding seam forming a cap protruding above an underwater surface of the vessel, and amending a profile of the hull by applying a fairing to the underwater surface and to the welding seam, particularly it may be applied after the welding seam is completely finished and cooled down.

In a second aspect, the invention provides a marine vessel with a welding seam extending on an underwater surface. The welding seam forms a cap projecting a seam-height in an outwards direction away from the underwater surface.

To reduce drag and thus potentially increase speed or reduce fuel consumption, the vessel further comprises a fairing extending in the longitudinal direction and projecting a fairing-height in the outwards direction. The fairing is arranged such that it covers at least a part of the welding seam and preferably completely encapsulates the welding seam. Further, the fairing extends on both sides of the welding seam and thereby covers at least a part of the underwater surface.

Particularly, the fairing may be arranged to at least partly cover welding seams assembling skin panels of the hull in a butt joint.

Preferably, the fairing-height decreases in a width direction along the underwater surface away from the welding seam such that the fairing becomes triangular when seen in a cross-section perpendicular to the longitudinal direction.

The fairing-height may be between 90 and 110 percent of the seam-height such that the welding seam is either completely covered, or such that at most 10 percent of the height of the welding seam is uncovered.

The fairing may terminate in two side edges extending in the longitudinal direction on opposite sides of the welding seam. Preferably, these side edges are parallel to the welding seam, and at least one of the side edges may extend at a distance of at least 5 times the fairing-height from the welding seam, e.g. 6, 7, 8, 9, or 10 times the fairing-height.

The distance from one side edge to the welding seam may equal the distance from the other side edge to the welding seam.

In one embodiment, the fairing has an outer surface facing away from the underwater surface, the outer surface being convex in a cross-section transverse to the longitudinal direction.

Any of the aspects mentioned relative to the method for improving the fluid dynamic profile may be applied also to the vessel, e.g. the aspect of covering the welding seams at most in the forward half of the vessel with a fairing and leaving the remaining welding seams without fairing.

In a third aspect, the disclosure relates to a coating system for an underwater surface of a vessel, the coating system comprises, in the mentioned order, at least one layer of a primer, e.g. an anticorrosive primer, e.g. based on epoxy and arranged towards the underwater surface, a fairing of the kind described relative to the first aspect of the invention, and a top coat. The top coat could comprise at least one layer of a fouling control surface coating system.

The fairing may particularly be made from a filler, e.g. applied on the primer.

The primer may particularly be an epoxy based primer, it may be low tar, or tar-less, it may have a viscosity below that of the filler, and it may particularly be applied in at least two separate layers.

The filler could particularly be an epoxy based filler, and it may particularly be in a colour different from the colour of the primer and the top coat.

In one embodiment, the top coat comprises one or more layers of a silicone or epoxy based coating, e.g. a fouling control surface coating system as described elsewhere herein.

The fouling control surface coating system may particularly be a self-polishing antifouling binder system, like hydrolysable acrylic binders although not restricted to such. Examples of a particular relevant system include: non-aqueous dispersion binder systems. Such non-aqueous dispersion-type resins and method for their preparation are described in, e.g., U.S. Pat. Nos. 3,607,821, 4,147,688, 4,493,914 and 4,960,828, Japanese Patent Publication No. 29,551/1973 and Japanese Laid-open Patent Application No. 177,068/1982; specifically, as the shell component constituting the non-aqueous dispersion-type resin, various high-molecular substances soluble in a low-polarity solvent which are described in, e.g., U.S. Pat. No. 4,960,828 (Japanese Laid-open Patent Application No. 43374/1989), can be used; silylated acrylate binder system, such as those described in EP 0 297 505 B1; metal acrylate binder system, such as those described in e.g. EP 0 471 204 B1, EP 0 342

276 B1, EP 0 779 304 A1, EP 0 204 456 B1 or Japanese Patent Kokai No. 16809/1989; hybrids of silylated acrylate and metal acrylate binder system, such as those described in KR 20140117986; polyoxalate binder system, e.g. as disclosed in WO 2015/114091; zwitterion binder system, e.g. as disclosed in WO 2004/018533 and WO 2016/066567; polyester binder, e.g. as disclosed in WO 2014/010702; hybrids of silylated acrylate, zwitterion binder system, polyester binder system, (natural) rosin, rosin derivatives, disproportionated rosin, partly polymerised rosin, hydrogenated rosin, gum rosin, disproportionated gum rosin, acrylic resins, polyvinyl methyl ether, and vinyl acetate-vinylchloride-ethylene terpolymers. Particularly in combination with a self-polishing fouling control coating system, the fairing may provide improved flow conditions and thus improved self-polishing effect and thus reduced fouling problems.

Among these, it is believed that rosin binder systems, non-aqueous dispersion binder systems, silylated acrylate binder systems, metal acrylate binder systems, hybrids of silylated acrylate and metal acrylate binder systems, polyoxalate binder systems, zwitterion binder systems, hybrids of silylated acrylate, zwitterion binder systems and polyester binder systems, are especially interesting.

In one embodiment, a tie-coat is applied between the fairing and the top coat, e.g. an epoxy, silicone, or polyurethane based tie-coat. The tie-coat could be applied in one or more layers.

LIST OF DRAWINGS

FIGS. 8*a*-8*e* illustrate different profiles of fairings;

FIGS. 9-13 illustrate results of different tests, and

Figure 14:
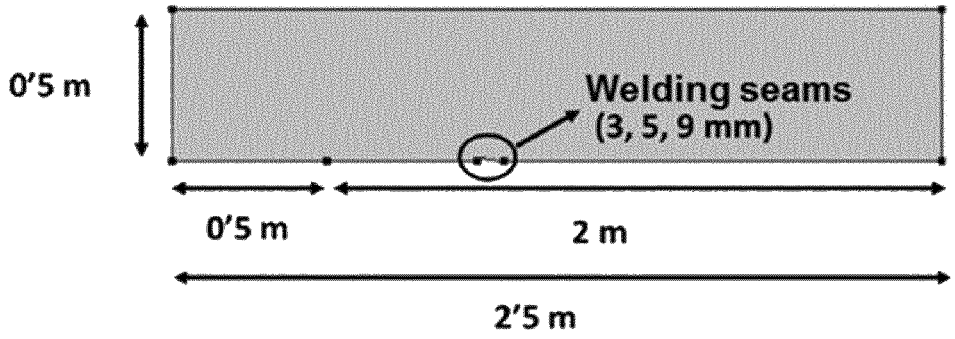
Figure 15:
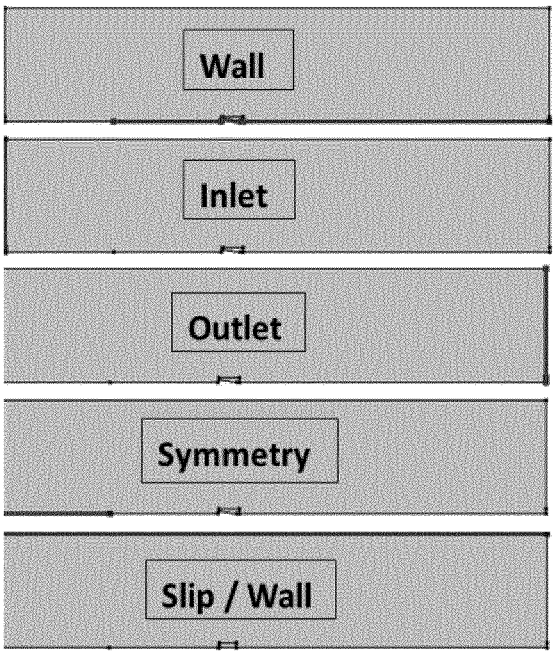
Figure 16:
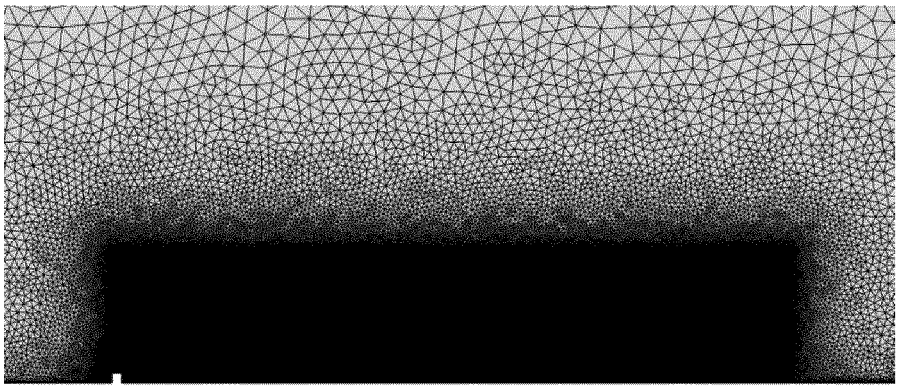

FIGS. 14-16 illustrate aspects related to CFD simulation.

DESCRIPTION OF EMBODIMENTS

Figure 1:
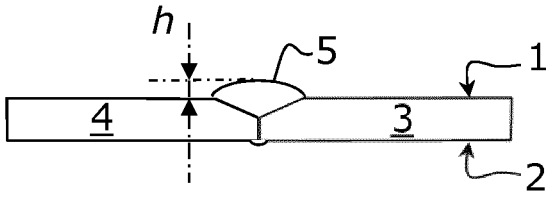
FIGS. 1-3 illustrate cross-sectional views of a steel plate under the waterline of a vessel.

FIG. 1 illustrates steel plate forming an underwater surface of a marine vessel. The outer surface 1, which is in contact with water, is illustrated upwards, and the inner surface 2 faces inwards, e.g. towards ballast tanks etc. The plate is constituted by two separate sheets 3, 4 of metal which are joined by welding. The welding joint forms a cap 5 projecting a seam-height in an outwards direction away from the underwater surface. The height is illustrated by the arrow h.

Figure 2A:
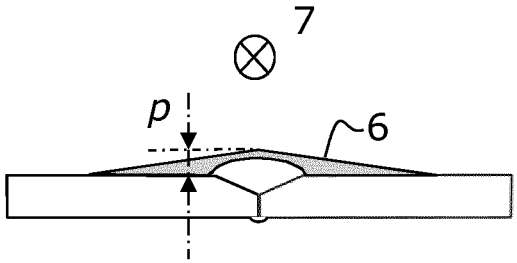

FIG. 2*a* illustrates the plate from FIG. 1 where a fairing 6 is made by applying filler over the welding seam. The fairing extends in the axial direction inwards and outwards of the plane defined by the cross-section. The axial direction is illustrated by the arrow 7.

The fairing projects a fairing-height, p, in the outwards direction and covers the welding seam and a part of the underwater surface.

Figure 2B:
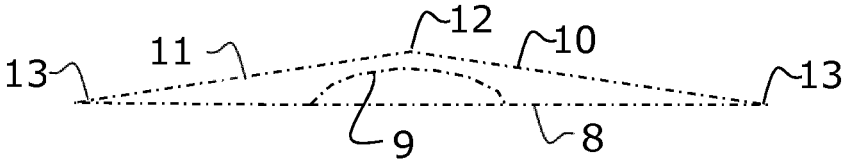

FIG. 2*b* illustrates an enlarged cross-section of the fairing. The fairing has a triangular shape forming a lower surface illustrated by the dotted line 8 against the underwater surface. The lower surface 8 is interrupted by the cone shape 9 created by the cap of the welding. Within the meaning of this document, the fairing is, however, noted as being triangular. The triangle also forms the two top surfaces 10, 11 extending from the top point 12 above the welding seam and sloping from that top point downwards towards the lower surface at the corners 13. The illustrated fairing has the shape of an isosceles triangle, i.e. having at least two sides of equal length.

Figure 3:
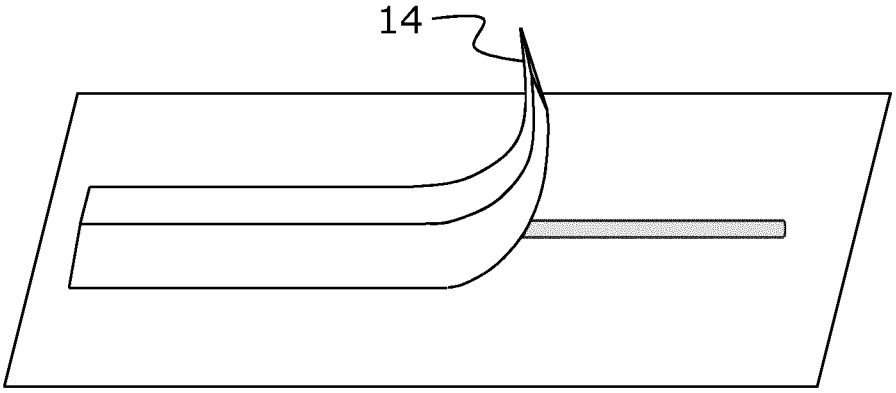

FIG. 3 illustrates a fairing 14 forming a separate component having a shape which is pre-defined and which is attached adhesively to the welding seam and underwater surface.

Figure 4:
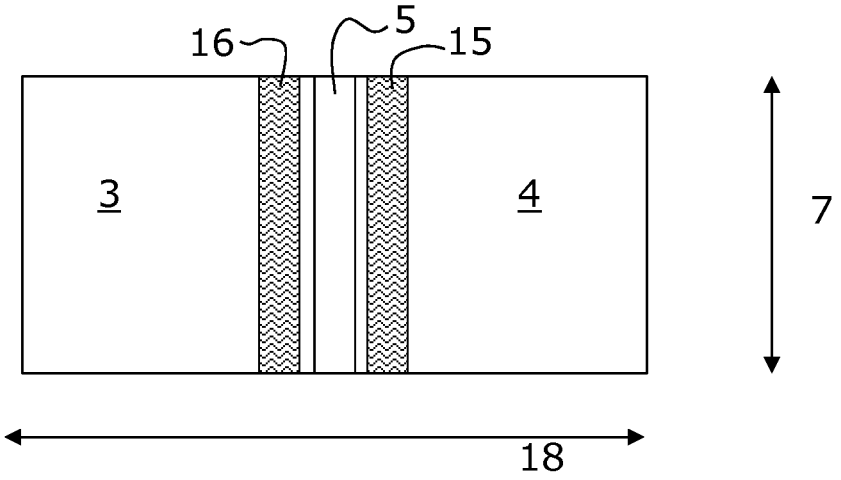
FIGS. 4-6 illustrate top views of the steel plates.

FIG. 4 illustrates the welding seam from FIG. 1 but seen above the outer surface, i.e. above the surface which is in contact with the water when the vessel is launched. In this view, two HAZ 15, 16 are illustrated on opposite sides of the welding cap. The two HAZ are a result of the excessive heat input from the welding process.

Figure 5:
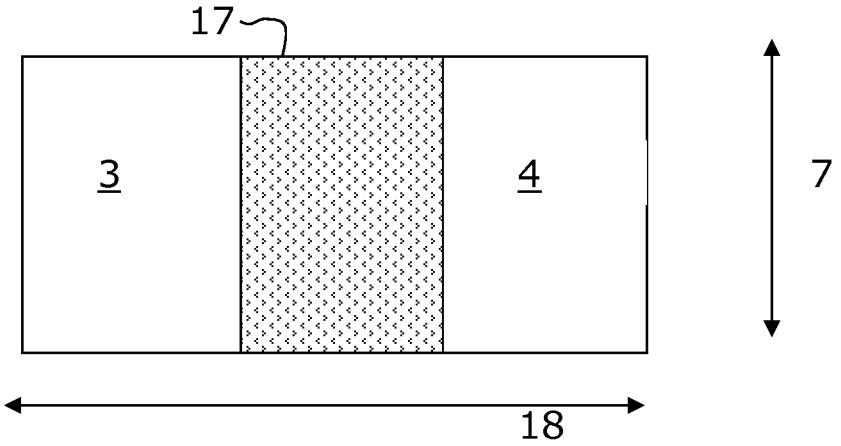

FIG. 5 illustrates the welding seam from FIG. 4 and with a fairing 17 covering not only the welding cap but also the two HAZ. The fairing thereby provides a smooth surface with reduced drag and increases the protection of the welding and HAZ.

Figure 6:
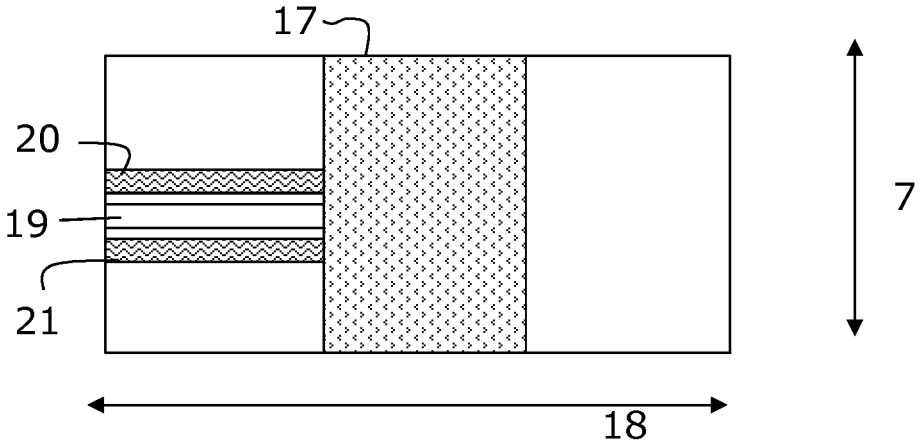

In FIGS. 4 and 5, the arrow 7 indicates the axial direction of the welding seam, and arrow 18 (and arrow 24 in FIG. 7) indicates the sailing direction for the vessel also referred to as the longitudinal direction. The invention may generally be applied to any of the welding seams on underwater surfaces. However, as illustrated in FIG. 6, the invention may be particularly useful when the fairing is applied exclusively to weld lines extending transverse to the sailing direction, herein referred to as "in the transverse direction". In FIG. 6, this is illustrated by the longitudinal welding seam 19 and HAZ 20, 21. Whereas the transverse welding seam 5 is covered by the fairing 17, the other, longitudinal, welding seam 19 extends in the sailing direction and is not covered. At the uncovered welding seam, the HAZ 20, 21 also extend uncovered.

Figure 7:
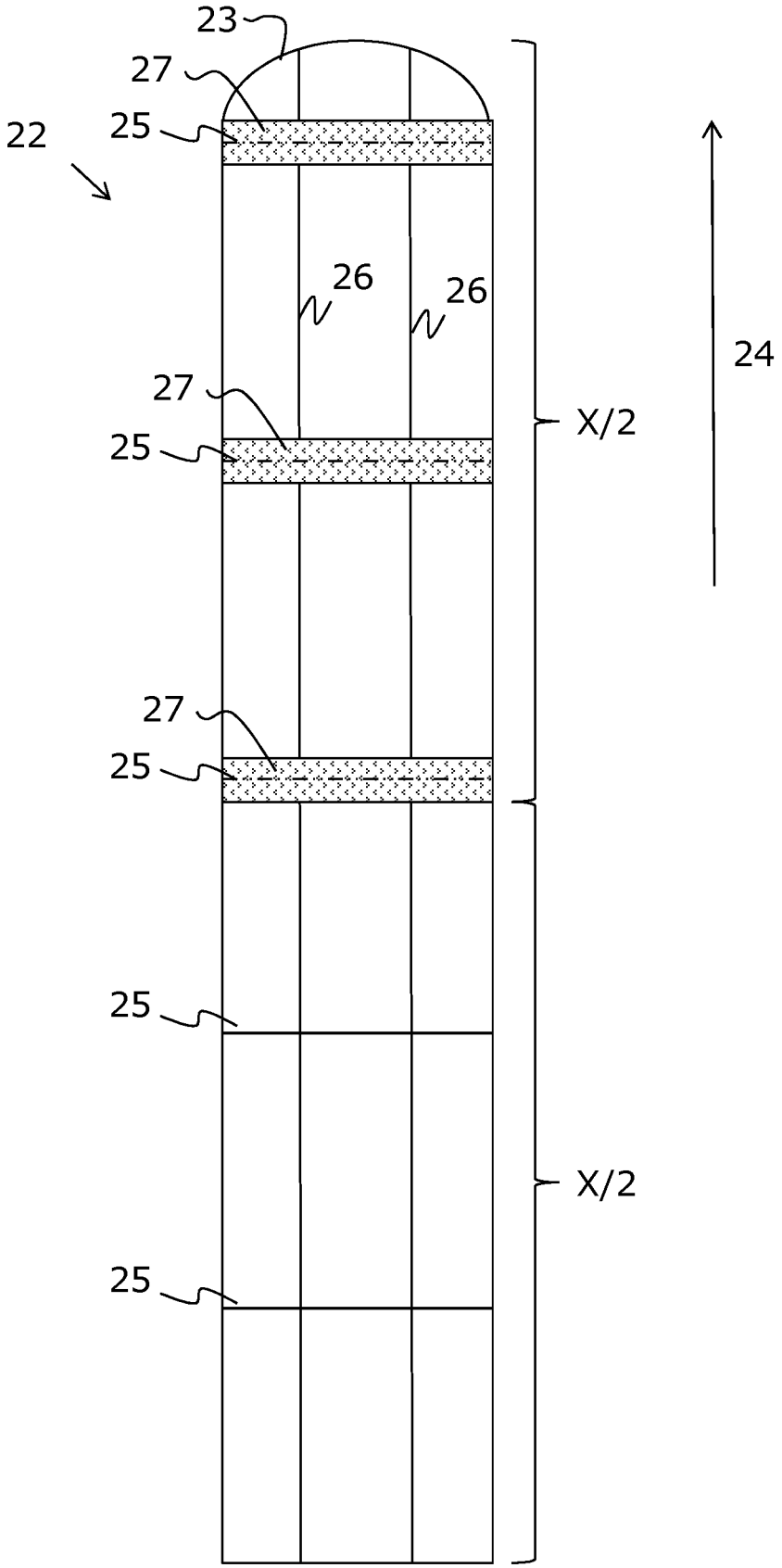
FIG. 7 illustrates a top view of a bottom surface of a vessel.

FIG. 7 illustrates a bottom 22 of a vessel. The vessel has a rounded stern 23 and is intended for the sailing direction indicated by the arrow 24 thereby also indicating the longitudinal direction. The vessel comprises a number of transverse welding seams 25 extending perpendicular to the sailing direction, and at least two longitudinal welding seams 26 extending in the sailing direction.

The fairings 27 of filler are applied only on welding seams in a forward half part of the underwater surface of the vessel. This is indicated by the distance indication X/2 for each of the two subsequent sections in the length direction.

FIGS. 8*a*-8*e* illustrate different profiles of fairings.

Figure 8A:
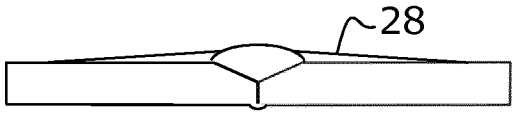

In FIG. 8*a*, the fairing 28 has a height below 100 pct. of the height of the cap of the welding seam and the cap therefore extends through the fairing. Even though the welding seam is visible through the fairing, the fairing protects and changes the flow conditions at the welding seam.

Figure 8B:
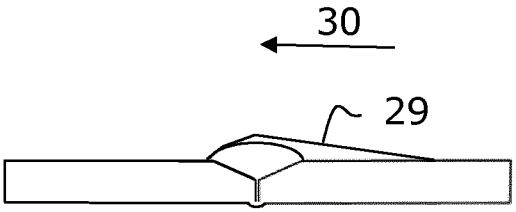

In FIG. 8*b*, the fairing 29 has a height above 100 pct. of the height of the cap of the welding seam but it is only arranged to cover the part of the welding seam and HAZ pointing downstream away from the sailing direction indicated by the arrow 30. By this type of fairing, the flow conditions are amended particularly downstream of the welding seam where fouling is sometimes experienced. The change in flow conditions caused by the fairing downstream the welding seam may reduce the fouling.

Figure 8C:
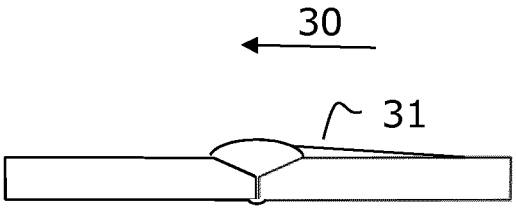

In FIG. 8*c*, the fairing 31 has a height below 100 pct. of the height of the cap of the welding seam and it is only arranged to cover the part of the welding seam and HAZ pointing downstream away from the sailing direction indicated by the arrow 30. The welding seam therefore extends through the fairing but the fairing still protects and changes the flow conditions at the welding seam.

Figure 8D:
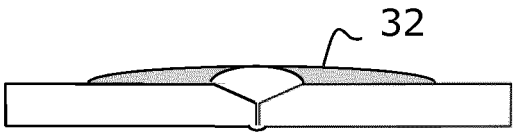

In FIG. 8*d*, the fairing 32 has a height of exactly 100 pct. of the height of the cap of the welding seam and it has a concave shape.

Figure 8E:
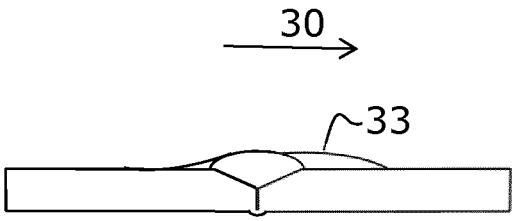
Figure 9:
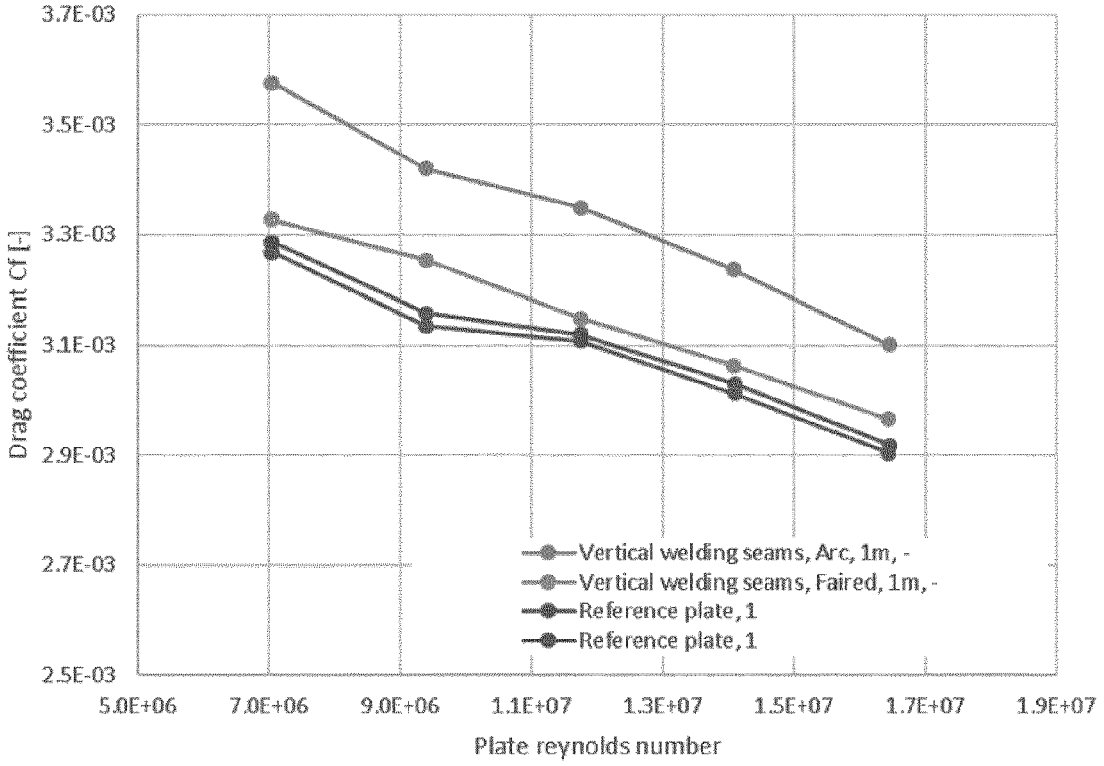
Figure 10:
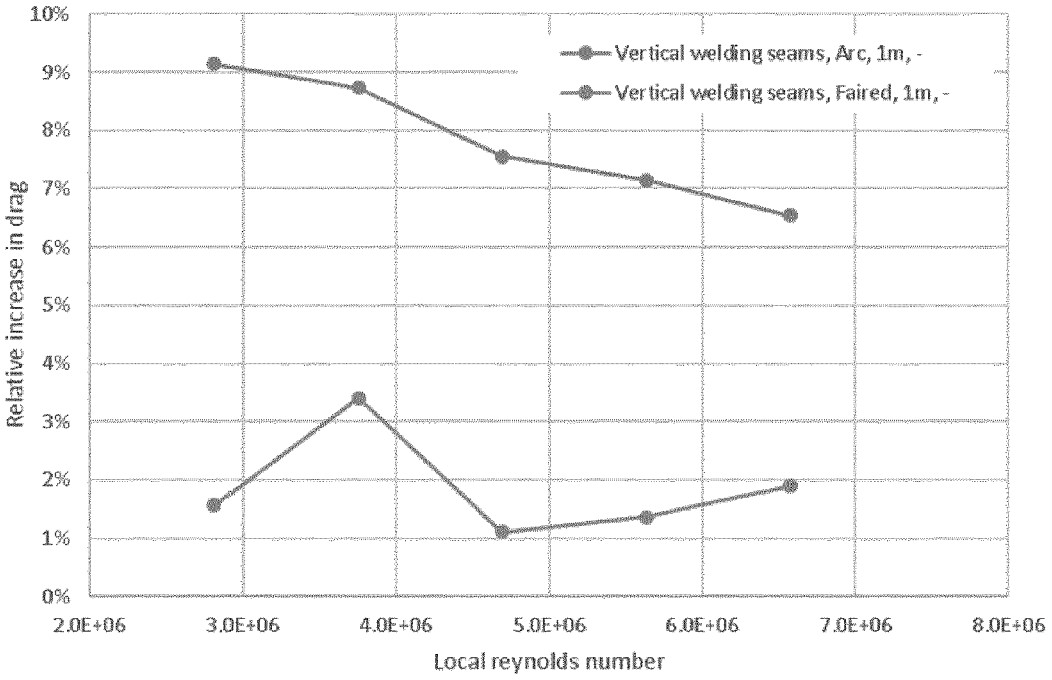

In FIG. 8*e*, the fairing 33 has a height of exactly 100 pct. of the height of the cap of the welding seam and that part of the fairing pointing in the sailing direction has a concave shape, and that part pointing rearwards relative to the sailing direction has a convex shape.

EXAMPLES

Example 1—Towing Tank Test

To investigate the effect on the resistance due to protruding welding seams on ship hulls, three resistance tests with flat plates with and without protrusions representing welding seams were performed in order to measure the added resistance from the welding seams.

Two different profiles were tested: one with an arc type cross section as illustrated in FIG. 1 corresponding to a welding seam without a fairing, and one with a smooth transition over the welding seam (as illustrated in FIG. 2*a*) simulating a fairing. The arc type welding seam had a cross section with a width of 12 mm and height 3 mm, and faired protrusion had the same height but a width of 60-100 mm.

Force measurements on thin flat plates were performed by FORCE Technology, Hjortekærsvej 99, DK-2800 Kongens Lyngby. The measurements were made in a 240 meter long towing tank with 5.5 meter deep water. The thin, flat 2.5×0.6 meter large plates were submerged from the rig and the drag forces were measured at speed from 3 to 7 m/s, from which the skin friction force and skin friction coefficient (Cf) was determined.

Three 5 mm anodized aluminium plates were prepared for the test program. A fairing was applied to the leading edge to reduce the wave making resistance and a 25 mm wide vertical sandpaper tape was located, on both sides, 0.1 m aft of the leading edge of the plate in order to stimulate a fully turbulent flow on the remaining part of the plate downstream. Before any testing with plates the air resistance of the test rig was identified by running test runs with the rig alone.

One welding seam were placed symmetrically on each sides of the plates, 1 m aft the leading edge, with the following dimensions:

| Welding type | Height [mm] | Width [mm] | Length [mm] |
|---|---|---|---|
| Arc | 3 | 12 | 485 |
| Faired arc | 3 | 60-80 | 485 |

Initially one smooth reference plate was tested without any protuberances in order to validate the test setup and determine the reference frictional resistance. Then the plate with the arc welding seam was tested and subsequently the plate with the fairing over the welding seam was tested. After the tests with the protrusions the smooth reference plate was tested again.

The drag measured during the test runs with welding seams was first subtracted by the air resistance and smooth plate resistance to arrive at the drag increment due to the welding seam. The drag coefficients of the plates are presented in FIG. 9 and the model scale drag increment is presented in FIG. 10. It illustrates that the transverse arc welding seams increase the smooth plate resistance by 6.5-9.2% where the fairing over the welding seam gave about 2% increase.

TABLE 1

Summary of the results showing the drag resistance of the plates with transverse welding seams.

| Run — | Test ID — | Speed m/s | Reynolds number Re (U*L/ny) — | Local reynolds number $Re_X$ U*X/ny — | Mean Drag N | STD drag N | Cd * — | Comments — |
|---|---|---|---|---|---|---|---|---|
| 13 | — | 3.000 | 7.04E+06 | | 0.21 | 0.07 | 1.74E−05 | Air resistance |
| 14 | — | 4.002 | 9.39E+06 | | 0.34 | 0.18 | 1.64E−05 | Air resistance |
| 15 | — | 5.003 | 1.17E+07 | | 0.30 | 0.33 | 9.25E−06 | Air resistance |
| 16 | — | 6.004 | 1.41E+07 | | 0.80 | 0.11 | 1.70E−05 | Air resistance |
| 17 | — | 7.017 | 1.65E+07 | | 1.06 | 0.13 | 1.64E−05 | Air resistance |
| 27 | 1 | 3.001 | 7.04E+06 | | 38.98 | 0.24 | 3.29E−03 | Reference plate, |
| 29 | 1 | 4.001 | 9.39E+06 | | 66.61 | 0.53 | 3.16E−03 | Reference plate, |
| 30 | 1 | 5.002 | 1.17E+07 | | 102.60 | 0.52 | 3.12E−03 | Reference plate, |
| 31 | 1 | 6.005 | 1.41E+07 | | 143.99 | 0.81 | 3.03E−03 | Reference plate, |
| 32 | 1 | 7.011 | 1.65E+07 | | 189.05 | 1.38 | 2.92E−03 | Reference plate, |
| 54 | 1 | 3.001 | 7.04E+06 | | 38.77 | 0.27 | 3.27E−03 | Reference plate, |
| 56 | 1 | 4.001 | 9.39E+06 | | 66.11 | 0.40 | 3.13E−03 | Reference plate, |
| 58 | 1 | 5.002 | 1.17E+07 | | 102.21 | 0.78 | 3.11E−03 | Reference plate, |
| 60 | 1 | 6.004 | 1.41E+07 | | 143.07 | 0.52 | 3.01E−03 | Reference plate, |
| 63 | 1 | 7.005 | 1.64E+07 | | 187.79 | 1.06 | 2.90E−03 | Reference plate, |
| 33 | 2 | 3.001 | 7.04E+06 | 2.82E+06 | 42.41 | 0.37 | 3.59E−03 | Vertical welding seams, Arc, 1 m, — |
| 35 | 2 | 4.001 | 9.39E+06 | 3.76E+06 | 72.14 | 0.36 | 3.44E−03 | Vertical welding seams, Arc, 1 m, — |
| 36 | 2 | 5.002 | 1.17E+07 | 4.70E+06 | 110.36 | 0.39 | 3.37E−03 | Vertical welding seams, Arc, 1 m, — |
| 37 | 2 | 6.003 | 1.41E+07 | 5.64E+06 | 153.30 | 0.50 | 3.25E−03 | Vertical welding seams, Arc, 1 m, — |
| 39 | 2 | 7.007 | 1.64E+07 | 6.58E+06 | 200.63 | 0.62 | 3.12E−03 | Vertical welding seams, Arc, 1 m, — |
| 43 | 4 | 3.000 | 7.04E+06 | 2.82E+06 | 39.46 | 0.33 | 3.35E−03 | Vertical welding seams, Faired, 1 m, — |

TABLE 1-continued

Summary of the results showing the drag resistance of the plates with transverse welding seams.

| Run — | Test ID — | Speed m/s | Reynolds number Re (U*L/ny) — | Local reynolds number $Re_X$ U*X/ny — | Mean Drag N | STD drag N | Cd * — | Comments — |
|---|---|---|---|---|---|---|---|---|
| 45 | 4 | 4.001 | 9.39E+06 | 3.76E+06 | 68.63 | 0.30 | 3.27E−03 | Vertical welding seams, Faired, 1 m, — |
| 47 | 4 | 5.002 | 1.17E+07 | 4.70E+06 | 103.78 | 0.27 | 3.17E−03 | Vertical welding seams, Faired, 1 m, — |
| 49 | 4 | 6.003 | 1.41E+07 | 5.64E+06 | 145.04 | 0.63 | 3.07E−03 | Vertical welding seams, Faired, 1 m, — |
| 51 | 4 | 7.004 | 1.64E+07 | 6.58E+06 | 191.78 | 1.42 | 2.98E−03 | Vertical welding seams, Faired, 1 m, — |

* (based on the wetted surface)

The drag coefficient is defined as $$C_D = \frac{D}{hlq}$$

Where

D is the drag h is the height of the protuberance (welding seam)

l is the length of the protuberance (welding seam)

q is the dynamic pressure, defined as $q=\frac{1}{2}\rho V^2$

The effective dynamic pressure is defined as $$\frac{q_{eff}}{q} \approx 0.75\sqrt[3]{h/\delta}$$

Where

δ is the maximum boundary layer thickness

Using the principle of effective dynamic pressure, the independent drag coefficient ($C_{D_{ind}}$) can be derived representing a drag coefficient in a free flow:

$$C_{D_{ind}} = \frac{C_D}{0.75\sqrt[3]{h/\delta}}$$

By applying this theory to the test results, the independent drag coefficient, $C_{D_{ind}}$, of the different kinds of protrusions can be established:

TABLE 2

Model test results represented as independent drag coefficients ($C_{D_{ind}}$) and the relative reduction of $C_D$

| Run | Test | Local Re — | Measured Additional drag N | Cd_measured/m (2D) — | delta/x — | delta m | q_eff/q — | Cd_ind — | Relative reduction Cd | Text 0 |
|---|---|---|---|---|---|---|---|---|---|---|
| 33 | 2 | 2.8E+06 | 3.53 | 0.279 | 0.018 | 0.018 | 0.409 | 0.683 | | Vertical welding seams, Arc, 1 m, — |
| 35 | 2 | 3.8E+06 | 5.76 | 0.256 | 0.018 | 0.018 | 0.415 | 0.618 | | Vertical welding seams, Arc, 1 m, — |
| 36 | 2 | 4.7E+06 | 7.70 | 0.219 | 0.017 | 0.017 | 0.419 | 0.523 | | Vertical welding seams, Arc, 1 m, — |
| 37 | 2 | 5.6E+06 | 10.19 | 0.201 | 0.017 | 0.017 | 0.423 | 0.476 | | Vertical welding seams, Arc, 1 m, — |
| 39 | 2 | 6.6E+06 | 12.23 | 0.177 | 0.016 | 0.016 | 0.426 | 0.416 | | Vertical welding seams, Arc, 1 m, — |
| 43 | 3 | 2.8E+06 | 0.60 | 0.048 | 0.018 | 0.018 | 0.409 | 0.117 | 83% | Vertical welding seams, Faired, 1 m, — |
| 45 | 3 | 3.8E+06 | 2.24 | 0.100 | 0.018 | 0.018 | 0.415 | 0.240 | 61% | Vertical welding seams, Faired, 1 m, — |
| 47 | 3 | 4.7E+06 | 1.14 | 0.032 | 0.017 | 0.017 | 0.419 | 0.077 | 85% | Vertical welding seams, Faired, 1 m, — |
| 49 | 3 | 5.6E+06 | 1.95 | 0.039 | 0.017 | 0.017 | 0.423 | 0.091 | 81% | Vertical welding seams, Faired, 1 m, — |
| 51 | 3 | 6.6E+06 | 3.54 | 0.051 | 0.016 | 0.016 | 0.426 | 0.120 | 71% | Vertical welding seams, Faired, 1 m, — |

Figure 11:
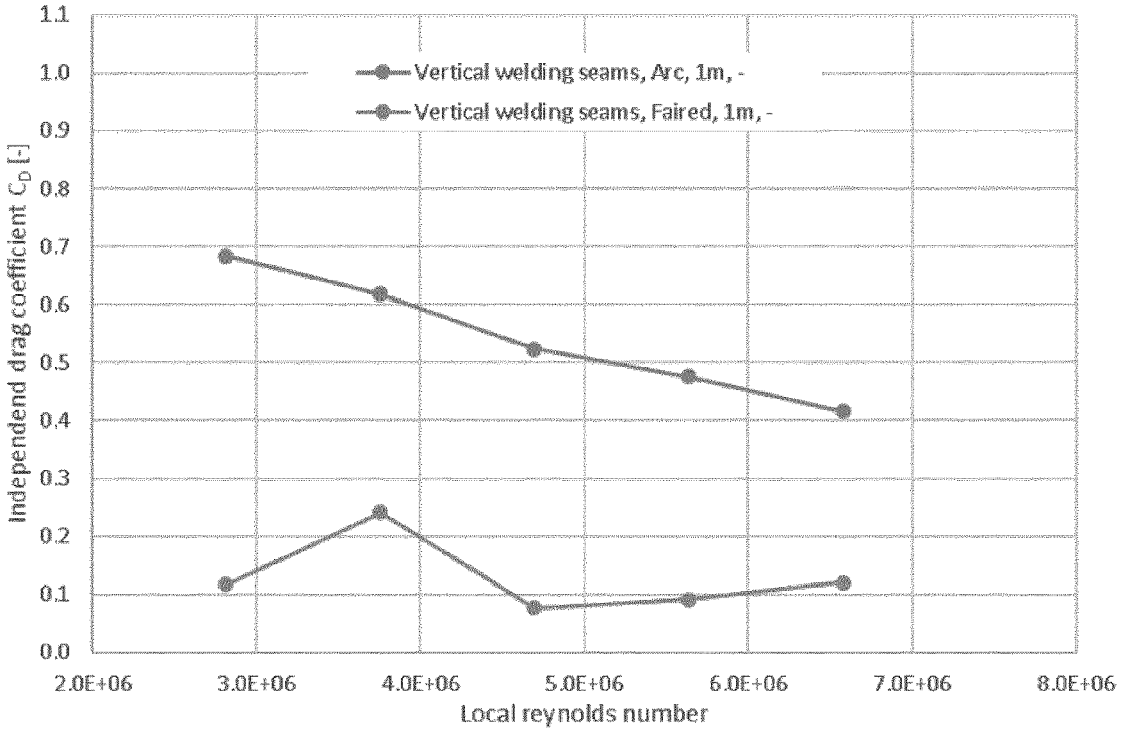

The results in table 2 are presented in FIG. 11. The welding seams with an altered profile, i.e. covered by a fairing according to the invention thus reduce the drag independent coefficient by 61-85% compared to a welding seam without fairing.

Example 2—Full Scale Extrapolation

The effective pressure principle from example 1 is used to estimate drag increment on a full scale ship. In order to estimate the full scale effect of the transverse welding seams an example has worked out for a 350 m containership. In this example the velocity along the hull outside the boundary layer is assumed to be constant along the hull. The transverse welding seams are assumed to extend along the entire girth for every 5 m from 50 m to 300 m from FP, i.e. transverse welding length per section 2×11 m+42.8 m=64.8 m. In this example the independent welding seam resistance coefficient for the arc is 0.5 and for the welding seam with a fairing, the resistance coefficient was 0.15. The vessel has the following characteristics that will be used in the analysis:

| Full scale | | | |
|---|---|---|---|
| Water line length | Lwl | 350 | m |
| Beam | B | 42.8 | m |
| Draught | T | 11 | m |
| Wetted surface | S | 16534.67 | $m^2$ |
| Seam height | h | 0.003 | m |
| Horizontal distance between vertical welding seams | | 5 | m |
| Kinematic viscosity | ny | 1.188E−06 | $s/m^2$ (15° C.) |
| Density | rho | 1025.88 | $kg/m^3$ (15° C.) |

At 16 knots, the added resistance due to each welding seam is listed in table 3. The sum of the increase in resistance compared to total calm water resistance shows a relative increase of 3.73% for arc welding seams.

Figure 12:
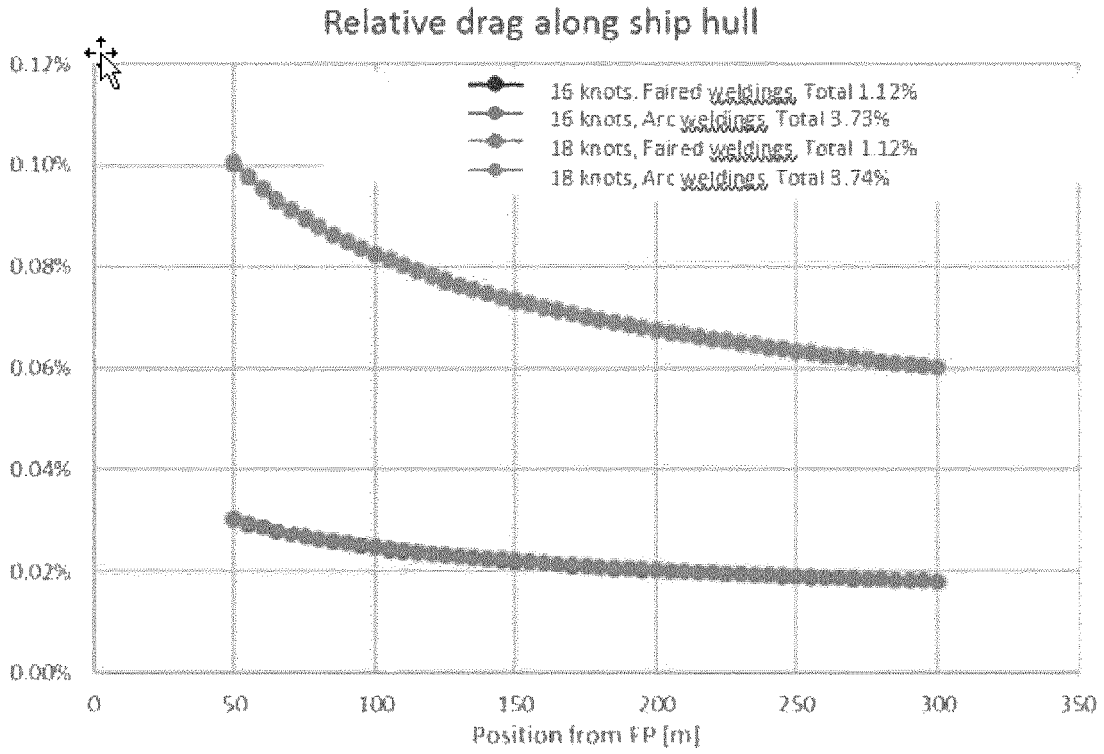

For welding seams with a fairing, the relative increase in resistance is 1.12%. FIG. 12 illustrates the added resistance along the container ship from 50 m to 300 m at two different speeds, 16 knots and 18 knots, for both arc welding seams and welding seams with a fairing.

These results clearly show the effect of altering the profile of an arc welding seam to a more smooth profile.

TABLE 3

The relative increase in resistance of arc welding seams on a full scale container ship, by extrapolation.

| V knots | δ/x — | x m | δ m | $q_{eff}/q$ — | $C_{d_ind}$ — | $C_{d_local}/m$ — | $R_{weld}$ N | $R_{tot}$ kN | $R_{increase}$ — |
|---|---|---|---|---|---|---|---|---|---|
| 16 | 0.93% | 50 | 0.464 | 0.140 | 0.5 | 0.070 | 944 | 941 | 0.10% |
| 16 | 0.92% | 55 | 0.504 | 0.136 | 0.5 | 0.068 | 919 | 941 | 0.10% |
| 16 | 0.90% | 60 | 0.543 | 0.133 | 0.5 | 0.066 | 896 | 941 | 0.10% |
| 16 | 0.89% | 65 | 0.581 | 0.130 | 0.5 | 0.065 | 876 | 941 | 0.09% |
| 16 | 0.88% | 70 | 0.619 | 0.127 | 0.5 | 0.063 | 857 | 941 | 0.09% |
| 16 | 0.88% | 75 | 0.657 | 0.124 | 0.5 | 0.062 | 841 | 941 | 0.09% |
| 16 | 0.87% | 80 | 0.694 | 0.122 | 0.5 | 0.061 | 825 | 941 | 0.09% |
| 16 | 0.86% | 85 | 0.731 | 0.120 | 0.5 | 0.060 | 811 | 941 | 0.09% |
| 16 | 0.85% | 90 | 0.768 | 0.118 | 0.5 | 0.059 | 798 | 941 | 0.08% |
| 16 | 0.85% | 95 | 0.804 | 0.116 | 0.5 | 0.058 | 786 | 941 | 0.08% |
| . | . | . | . | . | . | . | . | . | . |
| 16 | 0.72% | 300 | 2.115 | 0.084 | 0.5 | 0.042 | 566 | 941 | 0.08% |
| 16 | | | | | | | 35063 | 941 | 3.73% |

Figure 13:
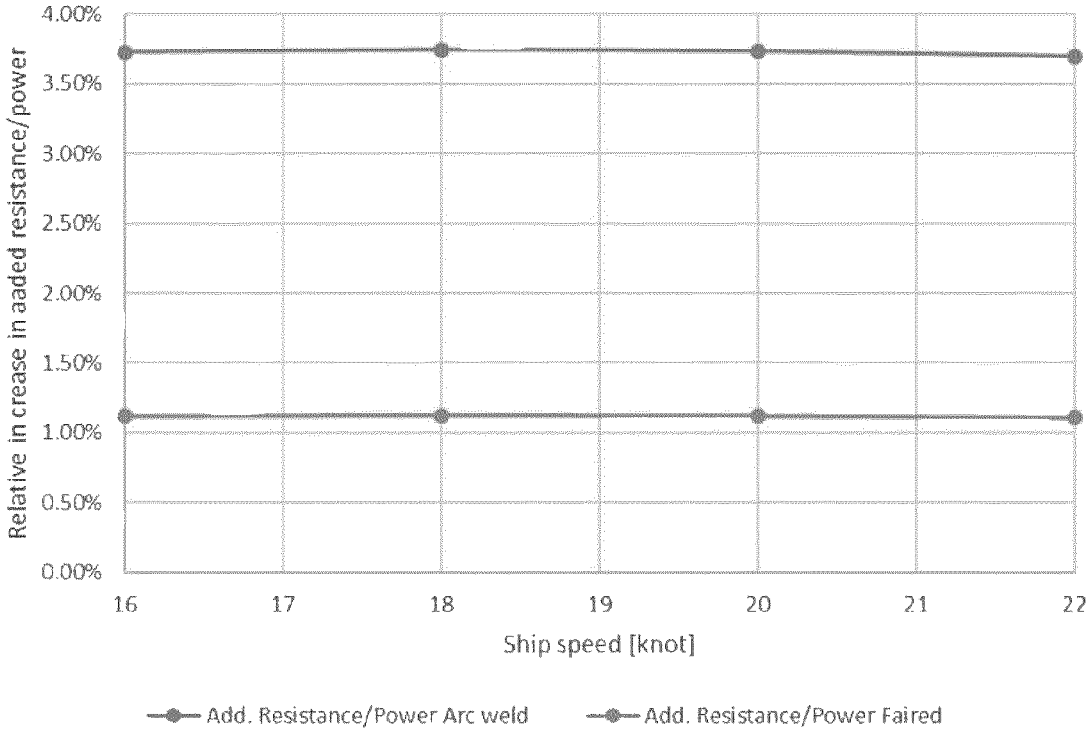

The relative increase was measured at speeds of 16, 18, 20 and 22 knots for both arc welding seams and welding seams with a fairing. The results are illustrated in FIG. 13. The relative increase in resistance is constant, at all speeds. The result shows the effect of altering the profile of an arc welding seam to a more smooth profile is reducing the drag resistance even when increasing or lowering the speed.

CFD Calculations

A 2-D rectangular geometry was used for the simulations (see below) with the water flowing from left to right at different speeds. The dimensions of the computational domain are illustrated in FIG. 14.

Simulations have been performed in steady state with the boundary conditions illustrated in FIG. 15. The simulations were performed by the Department of Fluid Mechanics, EEBE, Polytechnic University of Catalonia (UPC).

The k-ε and k-w models were used to model turbulence. With regards to the mesh far from the welding seams, a triangular grid was used with 94713 cells. The shape of the protuberance determines the refining necessary for an acceptable description of the wakes and re-circulations and, hence, the eventual increase of the total resistance Close to the welding seam, the mesh was refined as per the below.

The results are as follows. Note that the absolute values reported below are not relevant since the aim was not to describe the turbulence itself, but rather the influence of the turbulence on the mean flow (i.e. relative values).

| | Unmodified | Total filler area 6 cm | | Total filler area 26 cm | |
|---|---|---|---|---|---|
| Height of the welding seam | Total resistance (N/M) | Total resistance (N/M) | Relative Savings | Total resistance (N/M) | Relative Savings |
| 3 mm | 113.48 | 110.40 | 2.7% | 108.39 | 4.5% |
| 9 mm | 125.44 | 114.27 | 8.9% | 109.36 | 12.8% |

The influence of the speed was also assessed (see below for the 3 mm welding seams):

| | Unmodified | Total filler area 6 cm | | Total filler area 26 cm | |
|---|---|---|---|---|---|
| Speed (m/s) | Total resistance (N/M) | Total resistance (N/M) | Relative Savings | Total resistance (N/M) | Relative Savings |
| 6.18 | 113.48 | 110.40 | 2.7% | 108.39 | 4.5% |
| 8.23 | 193.29 | 187.90 | 2.8% | 184.21 | 4.7% |
| 10.29 | 292.94 | 284.40 | 2.9% | 278.66 | 4.9% |

The invention claimed is:

1. A method for improving a fluid dynamic profile of a marine vessel, the method comprising the step of identifying at least one welding seam forming a cap protruding above an underwater surface of the marine vessel, and amending a profile of the marine vessel by applying a fairing to the underwater surface and to the at least one welding seam, wherein the fairing is applied to the underwater surface and to the at least one welding seam by applying unsolidified filler to the underwater surface and to the at least one welding seam, shaping the filler, and solidifying the filler.

2. The method according to claim 1, wherein the unsolidified filler is applied from a pump into an application tool configured to be moved over the underwater surface and configured to define a shape of the fairing.

3. The method of claim 1, comprising the step of applying a fairing having a triangular shape forming a lower surface against the underwater surface and two top surfaces extending from a top point above the at least one welding seam and sloping from that top point downwards towards the lower surface.

4. The method of claim 3, comprising the step of applying a fairing having the shape of an isosceles triangle.

5. The method according to claim 1, wherein the fairing is applied to cover the at least one welding seam and a heat affected zone (HAZ) of the at least one welding seam.

6. The method according to claim 1, wherein the fairing is applied symmetrically about the at least one welding seam.

7. The method according to claim 1, wherein the fairing is applied over the at least one welding seam between a primer layer and a topcoat.

8. The method according to claim 1, wherein the fairing is covered with a fouling control surface coating system.

9. The method according to claim 1, comprising identifying at least one longitudinal welding seam extending on the underwater surface in a longitudinal direction in which the marine vessel is designed to sail, identifying at least one transverse welding seam extending on the underwater surface in a transverse direction being transverse to the longitudinal direction, and applying the fairing to the at least one transverse welding seam without applying a fairing to the at least one longitudinal welding seam.

10. The method according to claim 9, wherein the fairing is applied exclusively to at least one welding seam extending in a direction being perpendicular to the longitudinal direction.

11. The method according to claim 1, wherein the fairing is applied only on a downstream side of the at least one welding seam facing backwards relative to a sailing direction of the marine vessel.

12. The method according to claim 1, wherein the fairing is applied at most on at least one welding seam in a forward half part of the underwater surface of the marine vessel, the forward half part of the underwater surface extending from a front end pointing forward the sailing direction and half the way towards a rear end of the marine vessel.

13. The method according to claim 1, wherein the marine vessel is operated with a speed through water with the fairing applied to the underwater surface and at least one welding seam.

14. A marine vessel having a hull forming a welding seam extending along an underwater surface and forming a cap projecting a seam-height in an outwards direction away from the underwater surface, the marine vessel further comprising a fairing extending in an axial direction and projecting a fairing-height in the outwards direction and covering at least a part of the welding seam and underwater surface.

15. The marine vessel according to claim 14, wherein the fairing-height decreases in a width direction along the underwater surface away from the welding seam.

16. The marine vessel according to claim 14, wherein the fairing-height is between 90 and 110 percent of the seam-height.

17. The marine vessel according to claim 14, wherein the fairing terminates in two side edges extending in the axial direction on opposite sides of the welding seam.

18. A The marine vessel according to claim 17, wherein at least one of the side edges extends at a distance of at least 5 times the fairing-height from the welding seam.

19. The marine vessel according to claim 17, wherein the distance from one side edge to the welding seam equals the distance from the other side edge to the welding seam.

20. The marine vessel according to claim 14, wherein the fairing has an outer surface facing away from the underwater surface, the outer surface being convex in a cross-section transverse to the axial direction.

21. A coating system for an underwater surface of a marine vessel, the coating system comprising at least one layer of a primer applied to the underwater surface, a fairing configured to amend the profile of the underwater-surface at a welding seam and applied in accordance with claim 1, the fairing being applied to the primer, and a top coat applied to the fairing.

22. The coating system according to claim 21, further comprising a layer of a tie-coat applied between the fairing and the top coat.

23. The coating system according to claim 21, wherein the top coat comprises at least one layer of a fouling control surface coating system.

* * * * *